United States Patent [19]

Klein

[11] Patent Number: 4,708,662

[45] Date of Patent: Nov. 24, 1987

[54] CONNECTOR ASSEMBLY WITH PRE-STAGED TERMINAL RETAINER

[75] Inventor: David A. Klein, Kernersville, N.C.

[73] Assignee: AMP Incorporated, Harrisburg, Pa.

[21] Appl. No.: 876,572

[22] Filed: Jun. 20, 1986

[51] Int. Cl.[4] ..... H01R 13/627

[52] U.S. Cl. ..... 439/353; 439/357; 439/472

[58] Field of Search ..... 339/91 R, 59 R, 59 M, 339/61 R, 61 M; 24/522

[56] References Cited

U.S. PATENT DOCUMENTS

| | | | |
|---|---|---|---|
| 3,894,783 | 7/1975 | Messner | 339/91 R |
| 4,169,648 | 10/1979 | Moist, Jr. | 339/103 R |
| 4,284,313 | 8/1981 | Anhalt | 339/91 R X |
| 4,443,048 | 4/1984 | Moist, Jr. | 339/63 M |
| 4,544,220 | 10/1985 | Aiello et al. | 339/59 M |
| 4,583,805 | 4/1986 | Mantlik | 339/61 R |

*Primary Examiner*—Gil Weidenfeld
*Assistant Examiner*—Steven C. Bishop
*Attorney, Agent, or Firm*—Robert W. Pitts

[57] ABSTRACT

A pin and socket connector consisting of at least one connector half having a terminal retainer and a terminal housing which can be secured in a pre-staged and a final assembly position is disclosed. The terminal retainer includes a latching arm which engages the coupling fastener on the terminal housing in a pre-staged position and subsequently in a second fully assembled position. Terminals are removable from the terminal retainer in the pre-staged configuration but are positively secured within the connector when the terminal housing and the terminal retainer are in the fully assembled position.

12 Claims, 16 Drawing Figures

52
6
42
42
44
54
56
50
52

30
4
22
24

24
44
54

24
44
56

CONNECTOR ASSEMBLY WITH PRE-STAGED TERMINAL RETAINER

BACKGROUND OF THE INVENTION

1. Field of the Invention

The present invention relates to an electrical connector assembly including a terminal housing and a terminal retainer for maintaining the terminal securely positioned within the connector assembly, and more particularly to a pre-staged latch apparatus suitable for holding the terminal retainer and the terminal housing in two separate positions.

2. Description of the Prior Art

Pin and socket connectors employing pin and socket contacts crimped to wires and positioned within integrally molded plastic housings have been widely used in computers, business machines, home entertainment apparatus, vending machines, automobiles and in other applications. Commercial pin and socket connectors of this type are suitable for assembly by initially crimping individual pin and socket terminals to insulated wires and then inserting a plurality of crimped terminals into integrally molded plastic housings having cavities extending therethrough.

U.S. Pat. No. 4,443,048 discloses a pin and socket type connector assembly including a multicontact insulative housing and a terminal retainer which can be latched to the rear of the housing. The retainer shown therein can be disassembled from the terminal housing and frictional engagement of the retainer with the wires will serve to withdraw any terminal which is not properly seated within the connector housing.

Another connector of this type is shown in U.S. Pat. No. 4,544,220 which also discloses a terminal retainer which can be latched to a terminal housing. The terminal retainer shown therein employs a plurality of resilient fingers which can be flexed outwardly to receive a pin or socket terminal inserted through the terminal retainer fingers. The resilient fingers then engage the terminal after complete insertion, and when the retainer is secured to the terminal housing, the fingers are inwardly held to prevent withdrawal of the terminals. If terminals are only partially inserted through the resilient fingers, the terminal retainer shown therein cannot be mated with the connector housing. No pre-stage position in which the terminals, the terminal retainer and the terminal housing can be partially assembled, but in which terminals can be removed and replaced is possible with the device shown in U.S. Pat. No. 4,544,220.

U.S. Pat. No. 4,169,648 discloses a strain relief member which can be employed with pin and socket connectors of the general type referred to herein. The strain relief shown therein can be secured to the rear of a connector and pivotally moved to engage a plurality of wires secured to terminals located in the connector. This strain relief is suitable for use with a variable number of wires since it can be fastened in any position based upon the volume of wires extending from the connector.

Although the connectors shown in the prior art patents referred to above can be advantageously employed for the interconnection of large numbers of wires, these connectors are not capable of combining all the large number of features in a single connector assembly. One such feature is the necessity for assuring positive contact retention and positioning within the terminal insulative housing. Such positive contact retention assurance cannot be provided simply by requiring an assembler to physically determine if the contact has been fully inserted into the housing. Such positive contact assurance must be provided as an invariable factor in the normal assembly of the connector. Adequate strain relief for the conductors is also highly desirable and must be provided in a way that will not detract from other operational features of the connector or from the cost of the device. It is also desirable to provide a pre-staging or pre-assembly capability in which terminals can be properly positioned, although not fully inserted into the connector housing assemblies. This pre-staging position would permit removal and insertion of the terminals, but would also permit the entire assembly; consisting of connector housing components, terminals, and wires; to be handled as a single unit during assembly operations, but prior to locking the terminals within the housings. Furthermore, this pre-staged or pre-assembled position should not expose the terminals to the possibility of a shorting or the potential for electrical shock. Although these individual capabilities can be separably provided by one or another prior art apparatus, these prior art apparatus are not suitable for combination into an electrical connector exhibiting all of these advantageous characteristics.

SUMMARY OF THE INVENTION

This invention relates to an electrical connector assembly comprising at least one connector half which includes a plurality of terminals retained within a connector housing assembly consisting of at least a terminal retainer and a terminal housing. Both the terminal retainer and the terminal housing have aligned cavities for receiving individual terminals. The terminal housing and the terminal retainer each comprise one-piece molded insulative members which can be initially assembled in a first or pre-staged position and subsequently assembled in a second or assembled configuration. The terminal retainer can be latched to the terminal housing by one or more flexible latch arms extending from the front of the terminal retainer and engagable with a coupling flange on the terminal housing. The coupling flange comprises an open-ended envelope having an outer wall adjoined to the terminal housing by two end walls. Two latching bosses, one on the outer wall of the terminal housing and the other on the inner portion of the coupling flange outer wall are engagable with the terminal retainer latch arm to hold the terminal and the terminal retainer in first and second positions. To position the terminal retainer in the first or pre-staged configuration, the latch arm is inserted partially through the coupling flange past the first boss on the flange outer wall into engagement with the first boss. Subsequent insertion of the flexible arm completely through the coupling flange past the second boss moves the flexible arm into engagement with the outer wall to firmly secure the retainer to the terminal housing in the fully assembled position. The outer wall of the coupling flange is flexible to permit insertion of the arm through the coupling flange and the two bosses serve to outwardly displace the flexible arm as the arm moves from the first to the second position. The latch arms extend at the front end of the terminal retainer, and a strain relief can be attached to the terminal retainer at the rear on the same sides of the terminal retainer. The configuration of the latch arm and the strain relief straps on the terminal retainer is such that the terminal retainer can comprise an integrally molded one-piece member.

BRIEF DESCRIPTION OF THE DRAWINGS

FIG. 3 is an exploded perspective view showing two connector halves, each connector half consisting of a terminal housing and a matable terminal retainer.

FIG. 9 is a front view of the terminal retainer.

DETAILED DESCRIPTION OF THE PREFERRED EMBODIMENT

Figure 1:
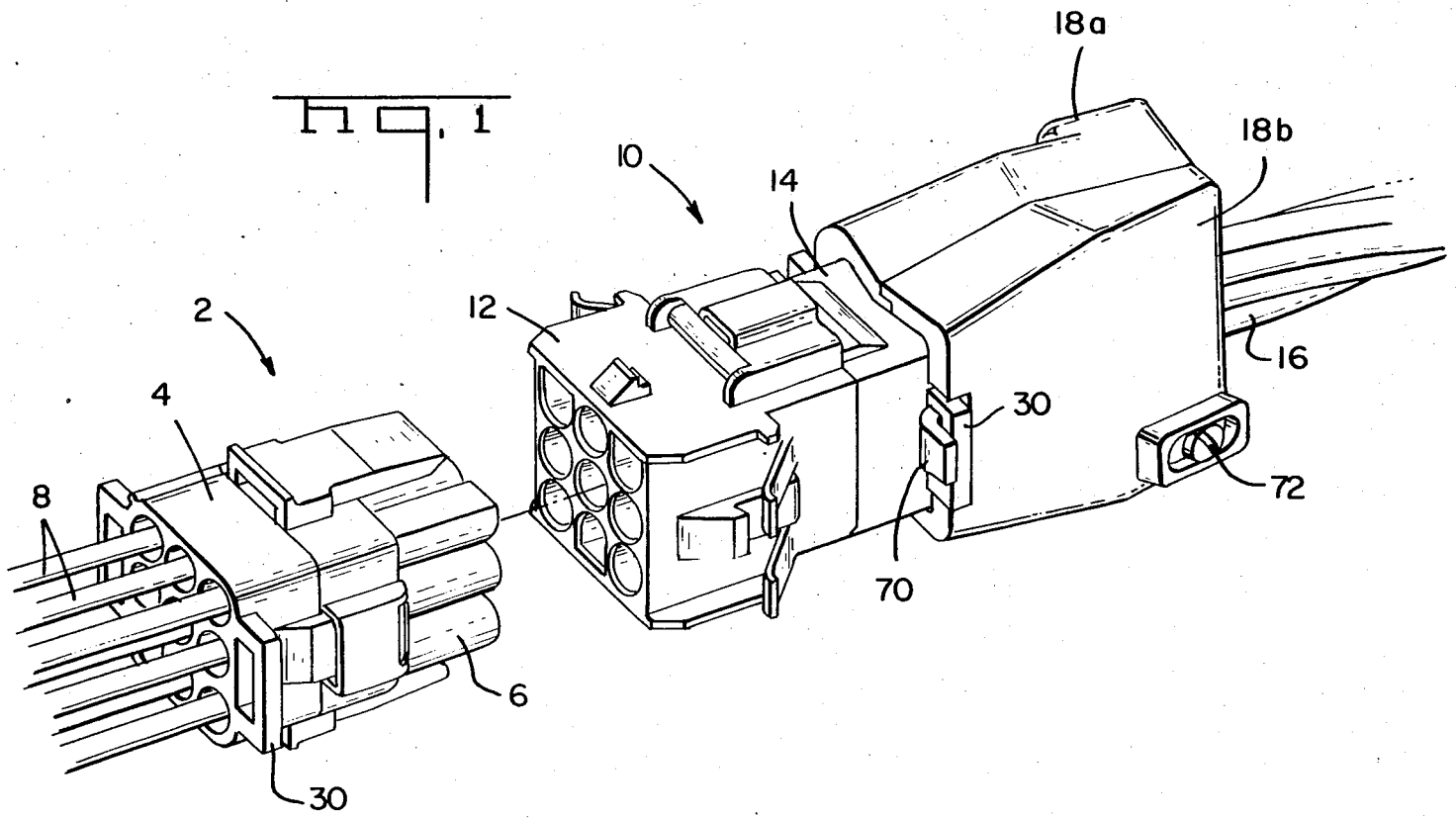
FIG. 1 is a perspective view of a connector assembly consisting of two connector halves, with a strain relief attached to one connector half prior to complete engagement.
Figure 2:
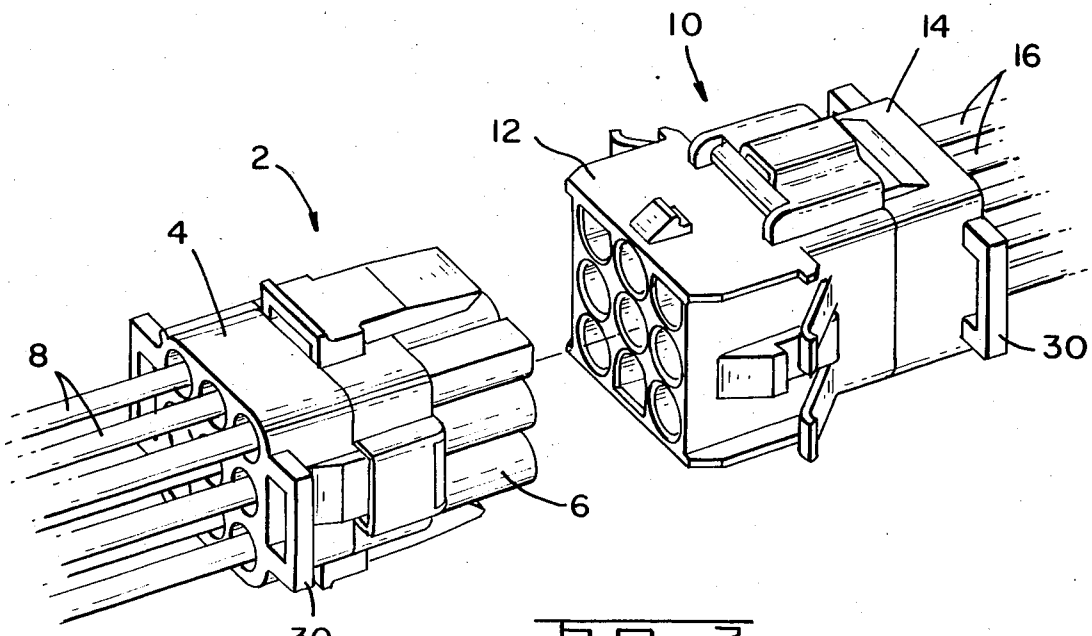
FIG. 2 is a perspective view similar to FIG. 1, but without the strain relief.
Figure 1:
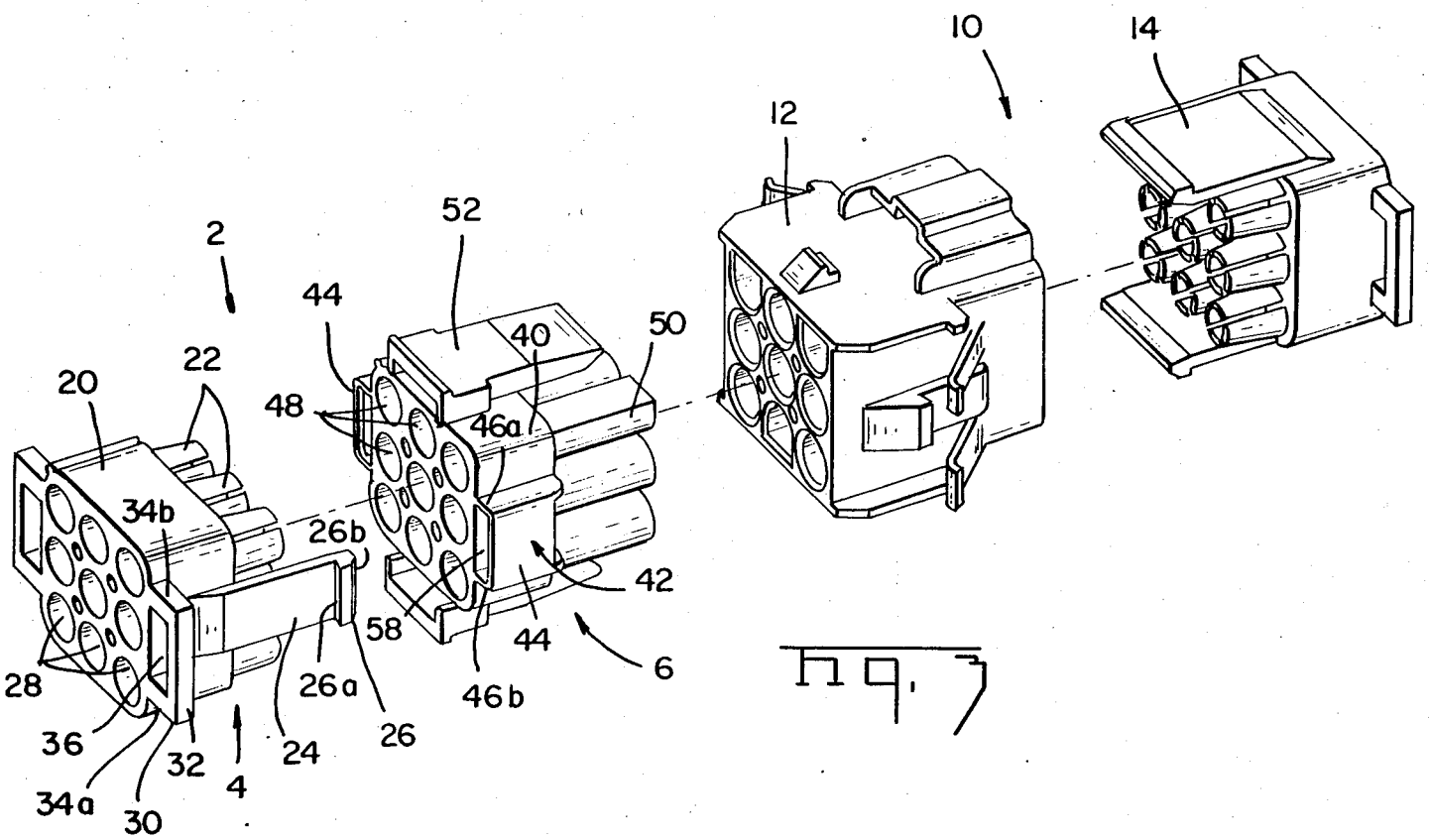

The preferred embodiment depicted herein consists of two connector halves 2 and 4 each containing a plurality of contact terminals mounted within insulating housing subassemblies. The preferred embodiment consists of pin and socket connectors, and the configuration of connector half 2 necessarily differs from the configuration of connector half 4. As depicted herein, connector half 2 is suitable for receiving socket terminals whereas mating pin terminals would be retained within connector half 12. As shown in FIG. 2, connector half 2 consists of a terminal retainer 4 which can be secured to a terminal housing 6. Discrete insulated wires or conductors 8 extend from the rear of connector half 2 and are crimped to terminals located within connector half 2 by conventional crimped means. Connector half 10 also consists of a terminal housing 12 and a terminal retainer 14 from which corresponding discrete electrical conductors 16 extend. Connector halves 2 and 10 can be mated to form a disengageable interconnection between corresponding conductors 8 and 6.

FIG. 3 shows an exploded view of the two connector halves 2 and 10. The terminal retainer 4 and the terminal housing 6 comprising connector half 2 are shown in exploded configuration. The connector half 10 consists of terminal housing 12 and terminal retainer 14. Terminal housing 12 and terminal retainer 14 are each described in greater detail in U.S. Pat. No. 4,544,220 entitled "Connector Having Means For Positively Seating Contacts". The description of the connector half 10 contained in U.S. Pat. No. 4,544,220 is hereby incorporated by reference.

Terminal retainer 4 consists of a one-piece molded housing formed of a suitable plastic material such as a conventional nylon. Other suitable plastics having a degree of flexibility could also be employed to mold the terminal retainer 4. Terminal retainer 4 consists of a body 20 having a plurality of terminal retention fingers 22 extending from the front edge of body 20. A pair of flexible arms 24 extend from opposite sides of the front of terminal body 20. In the preferred embodiment of this invention, the flexible arms 24 extend beyond the resilient fingers 22. Each flexible arm 24 is integrally joined to the body 20 at its rear and has an outwardly projecting shoulder 26 at its free or forward end. Shoulder 26 is formed by a forwardly facing camming surface **26*b* and a generally perpendicular locking surface 26*a* at its rear outward extent. A strap section 30 extends outwardly at the rear of terminal body 20 on the same sides of the the terminal body 20 as the two flexible arms 24. Strap 30 consists of an outer arm 32 and two end arms 34*a* and 34*b* extending between arm 32 and the terminal retainer body 20. Straps 30 form open ended passages defining a closed envelope. In the preferred embodiment of this invention, the width of the flexible arms 24 is no greater than the width of the passages 36 extending through the strap 30. Since the terminal retainer is molded, the exterior of the flexible arms 24 can be defined by a core pin which is removable through the passage 36 of strap 30. A plurality of apertures 28 extend from the rear of terminal retainer body portion 20 through the flexible fingers 22. Apertures 28 are shown more clearly in FIG. 4**.

The terminal housing 6 is formed of a flexible insulative plastic material having generally the same characteristics as the material from which the terminal retainer 4 is formed. Terminal housing 6 is also an integrally molded one-piece body and has a plurality of cylindrical projections or silos 50 extending from the front portion of the terminal body 40. A plurality of cavities 48 extend through the rear face to the front face of the terminal body 6. Each cavity 48 extends through a corresponding silo 50. A pair of coupling flanges 42 extend from opposite sides of the terminal body 40. Each coupling flange 42 comprises an open-ended envelope consisting of an outer wall 44 joined to the terminal body by two spaced endwalls **46*a* and 46*b*. A pair of connector latches 52 extend from the two remaining opposite sides of the terminal body 40 and extend forwardly for engagement with appropriate latching means on mating connector half 10**.

Figure 4:
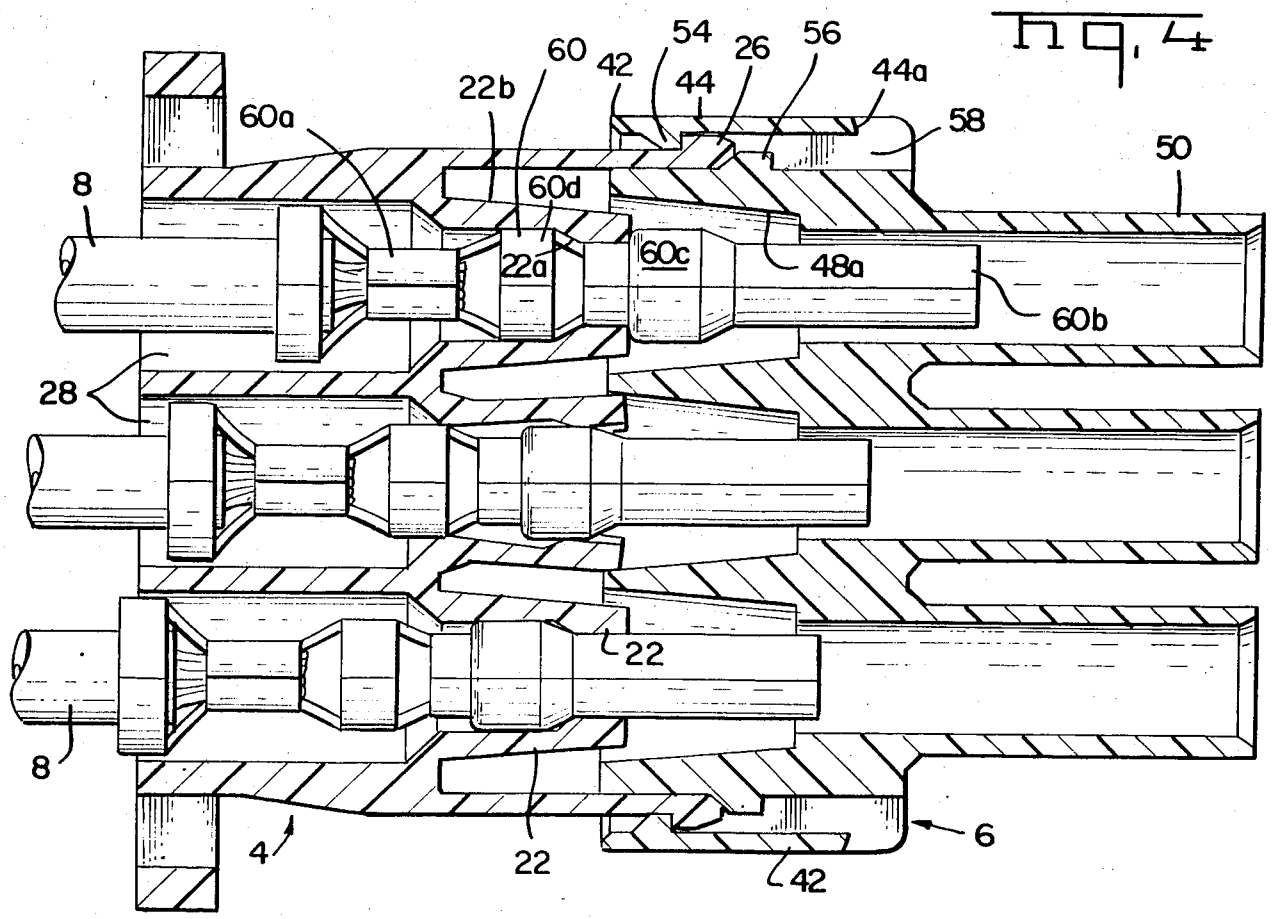
FIG. 4 is a sectional view showing a connector half consisting of terminal housing and terminal retainer in accordance with the preferred embodiment of this invention and three possible positions of terminals positioned in the pre-staged terminal retainer.

The terminal retainer 4 and the terminal housing 6 can be joined in two positions, the first position represents a partially assembled or pre-staged position in which the terminal retainer 4 is attached to the terminal housing 6, but the terminals are not permanently retained within the terminal retainer 4 nor fully seated within the terminal housing 6. The terminal retainer 4 and the terminal housing 6 can also be secured in a fully assembled or second configuration in which the terminals are positively seated and the terminal retainer 4 is positively secured to the terminal body 6. FIG. 4 shows the first or pre-staged or partially assembled configuration. Terminals 60 are shown in three possible positions.

The upper terminal in FIG. 4 is fully inserted into the resilient fingers 22 of the terminal retainer. The central terminal is only partially inserted within the resilient fingers 22, and each resilient finger is cammed outwardly as shown in FIG. 4. The lower terminal in FIG. 4 is also incompletely inserted within the resilient fingers 22, but the resilient fingers are not cammed outwardly. There is no force acting on the lower terminal in FIG. 4 to retain the terminal within the terminal retainer nor is there any deflection of resilient fingers 22. In the pre-staged configuration of FIG. 4, the resilient fingers 22 are sufficiently flexible to permit withdrawal of a terminal 60 from the fully inserted position shown at the top of FIG. 4. Thus, a terminal can be removed when the terminal retainer 4 and the terminal housing 6 are in the partially pre-staged configuration shown in FIG. 4. The terminal retainer 4 is held in the pre-staged configuration with respect to terminal housing 4 by the interengagement of the shoulder 26 and a first latching boss 54 located on the interior of outer wall 44 and protruding into the passage 58 of the coupling flange 42.

Figure 5:
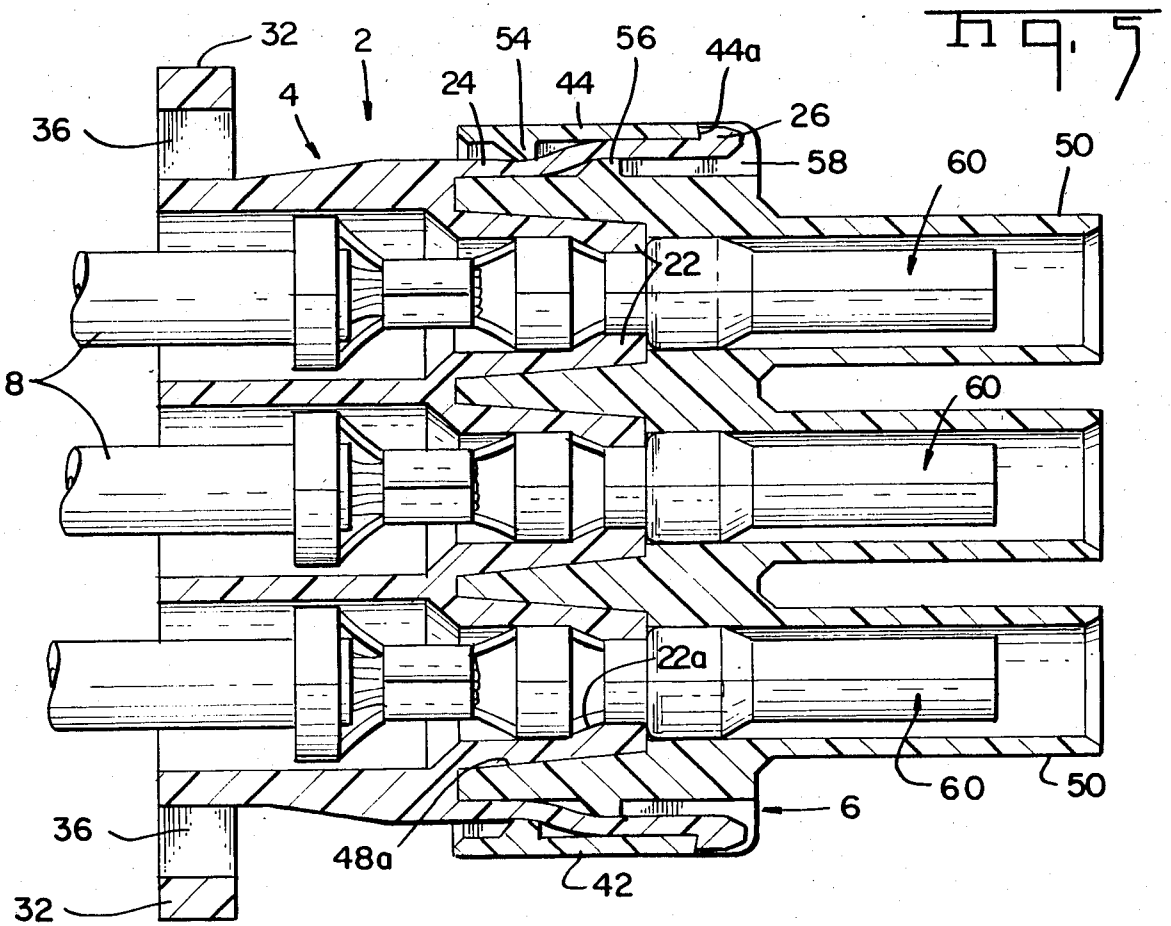
FIG. 5 is a sectional view showing a fully assembled connector half consisting of terminal housing and a terminal retainer with a plurality of contacts properly inserted and retained within the connector half.

FIG. 5 is similar to FIG. 4 but shows the terminal retainer 4 and the terminal housing 6 in the fully assembled configuration. Note that in Figure 5, all of the terminals are properly retained by the resilient fingers 22. Note that each terminal consists of a forward enlarged bearing section 60*c* and a rear formed bearing section 60*d* which are located on opposite sides of the enlarged free ends 22*a* of resilient fingers 22. In the fully inserted position shown in FIG. 5, the resilient fingers 22 have been moved into conical section 48*a* of cavities 48 and the resilient fingers 22*a* are not free to expand. Note that positive terminal retention is assured since the resilient fingers 22 cannot be received within conical section 48*a* unless the terminal is inserted completely through the resilient finger 22 with the bearing sections 60*c* and 60*d* on opposite sides of the enlarged finger ends 22*a*. Thus with the terminal retainer 4 and the terminal housing 6 in the fully assembled position of FIG. 4, the terminals cannot be withdrawn either intentionally or accidentally from the rear of the connector half 2. As shown in FIG. 5, the resilient arm 24 engages the forward end 44*a* of the outer wall of the coupling fastener 42. A second boss 56, on the outer portion of the wall of the housing extends into passage 58 and cams the flexible arm 24 and the shoulder 26 outward into engagement with the edge 44*a*. Note that shoulder 26 is adapted to engage two separate surfaces on the coupling fastener in the partially assembled and the fully assembled positions respectively. In the partially assembled configuration, the shoulder 26 engages the first latching boss 54. In the second configuration, the flexible arm 24 and the shoulder 26 are cammed outwardly relative to the pre-staged position to engage the outer wall of the coupling fastener 42.

Figure 6A:
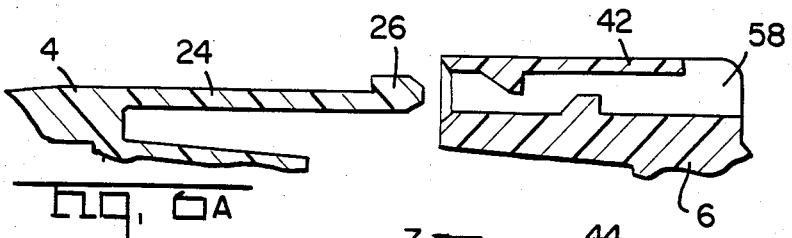
FIGS. 6A–6F disclose the progressive latching engagement between a flexible arm and a coupling flange on the terminal retainer and the terminal housing respectively, in which the terminal retainer removes from a completely disassembled position into a pre-staged position and finally into a completely assembled and locked configuration.
Figure 6B:
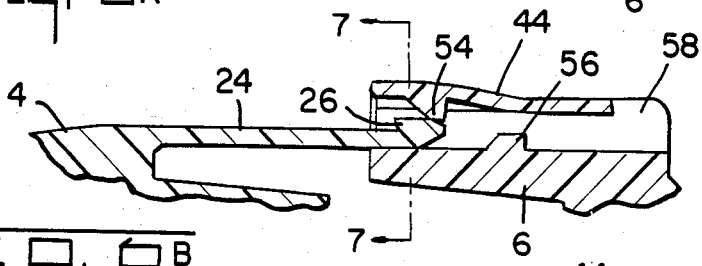
Figure 6C:
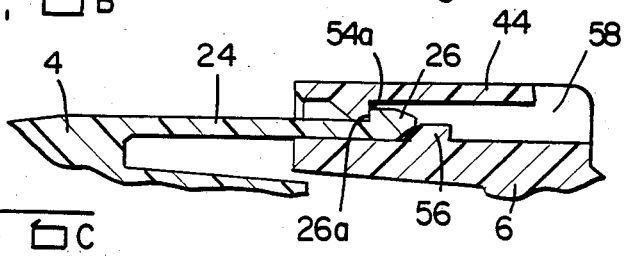
Figure 6D:
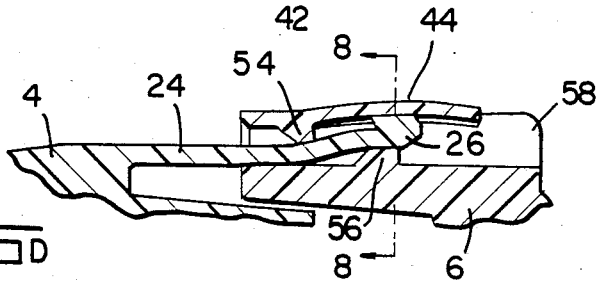
Figure 6E:
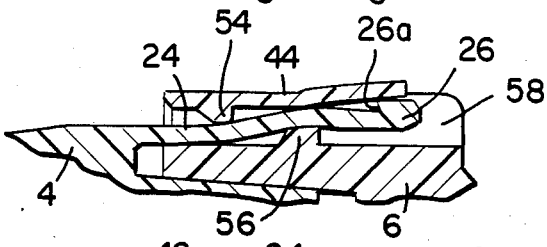
Figure 6F:
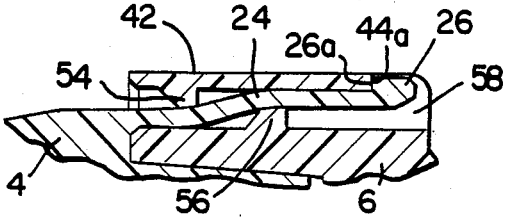

The action of the latching means which assembles the terminal retainer 4 and the terminal housing 6 in both the pre-staged and the fully assembled positions is shown in FIG. 6A–6F. FIG. 6A shows a partial cutaway of the flexible latching arm 24 on the terminal retainer aligned with the passage 58 in the coupling fastener 42. FIG. 6B shows the outward deflection of the outer wall 44 of coupling fastener 42 as the shoulder 26 on the free end of latching arm 24 is moved past the first latching boss 54. Note that the flexible construction of the integrally molded terminal housing 6 permits outward deflection of the outer wall 44 to prevent movement of shoulder 26 past the first latching boss 54. As shown in FIG. 6C the resilient outer wall 44 returns substantially to its initial configuration after passage of shoulder 26 past the first latching boss 54. The flat surfaces 26*a* on the latching arm shoulder and 54*a* on the first latching boss 54 serve to resist movement of the shoulder 26 out of the passage 58. Shoulder 26 is thus trapped between first latching boss 54 and second latching boss 56, and a significant force is required to move the latching shoulder 26 from the pre-staged position shown in FIG. 6C. As shown in FIG. 6D further movement of the latching arm 24 into the passage 58 cams the free end 26 of the latching arm outwardly causing flexure of the outer wall 44 of the coupling flange 42. Continued movement of the latching arm 24 past the second latching boss 56 is shown in FIG. 6E. Note that the relative position of the second latching boss 56 does not permit the flexible arm free end to return to its normal position after the shoulder 26 passes the latching boss 56. FIG. 6F shows the fully assembled configuration in which the shoulder 26*a* engages the edge 44*a* on the outer wall of the coupling fastener 42 to firmly lock the terminal retainer to the terminal housing. Note that the latching engagement between shoulder 26*a* and edge 44*a* is outwardly displaced from a location of the latching engagement between shoulders 54*a* and 26*a* in FIG. 6C.

Figures 7, 8, 10:
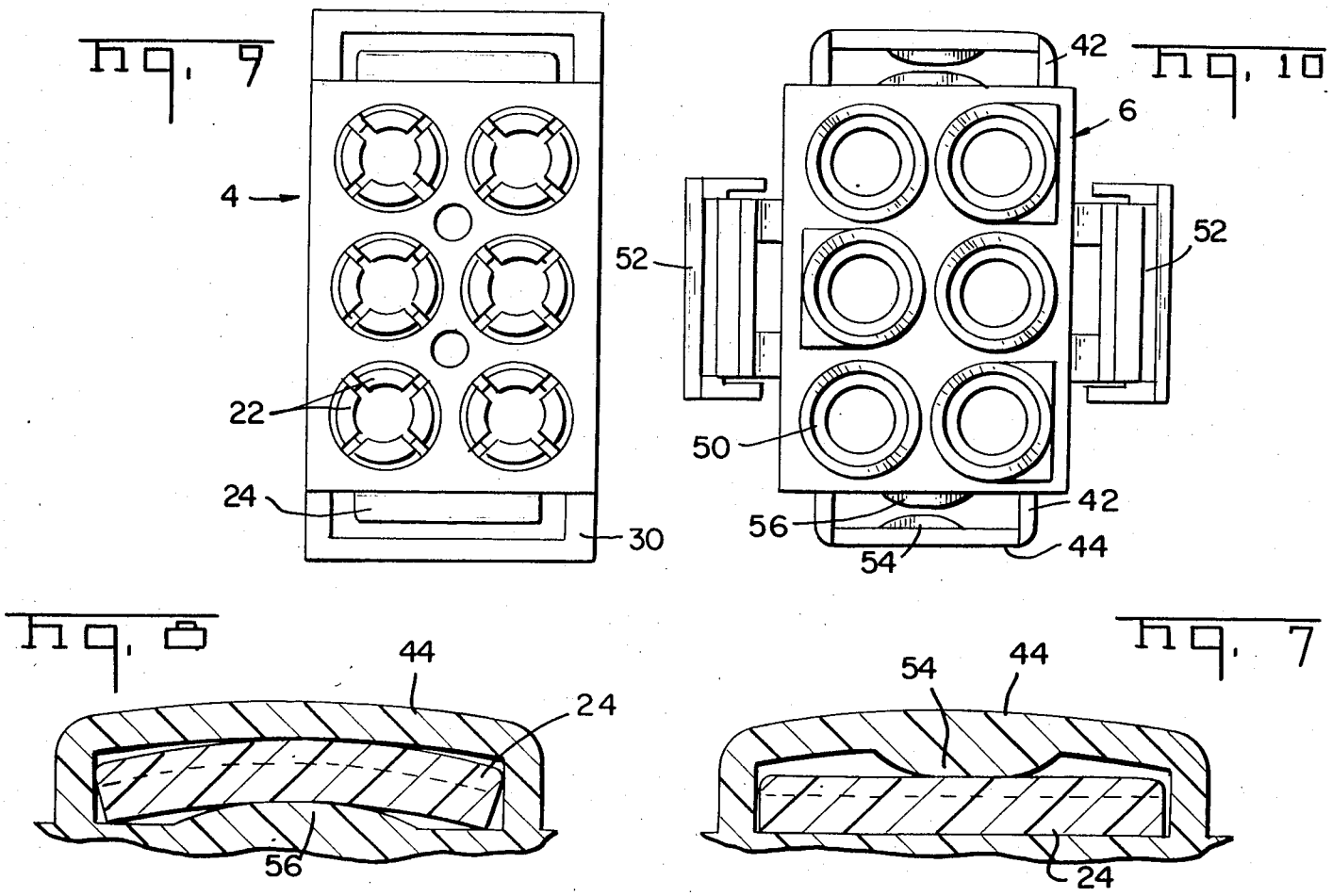
FIG. 7 is a sectional view taken along section line 7—7 in FIG. 6B.
FIG. 8 is a cross sectional view taken along section line 8—8 in Figure 6D.
FIG. 10 is a front view of the terminal housing.

The deflection of the outer wall 44 and the flexible arm 24, as the flexible arm moves past latching bosses 54 and 56 is illustrated in the cross sectional views of FIGS. 7 and 8. Note that both the coupling fastener and the flexible arm are free to flex in the configuration as shown.

Figure 11:
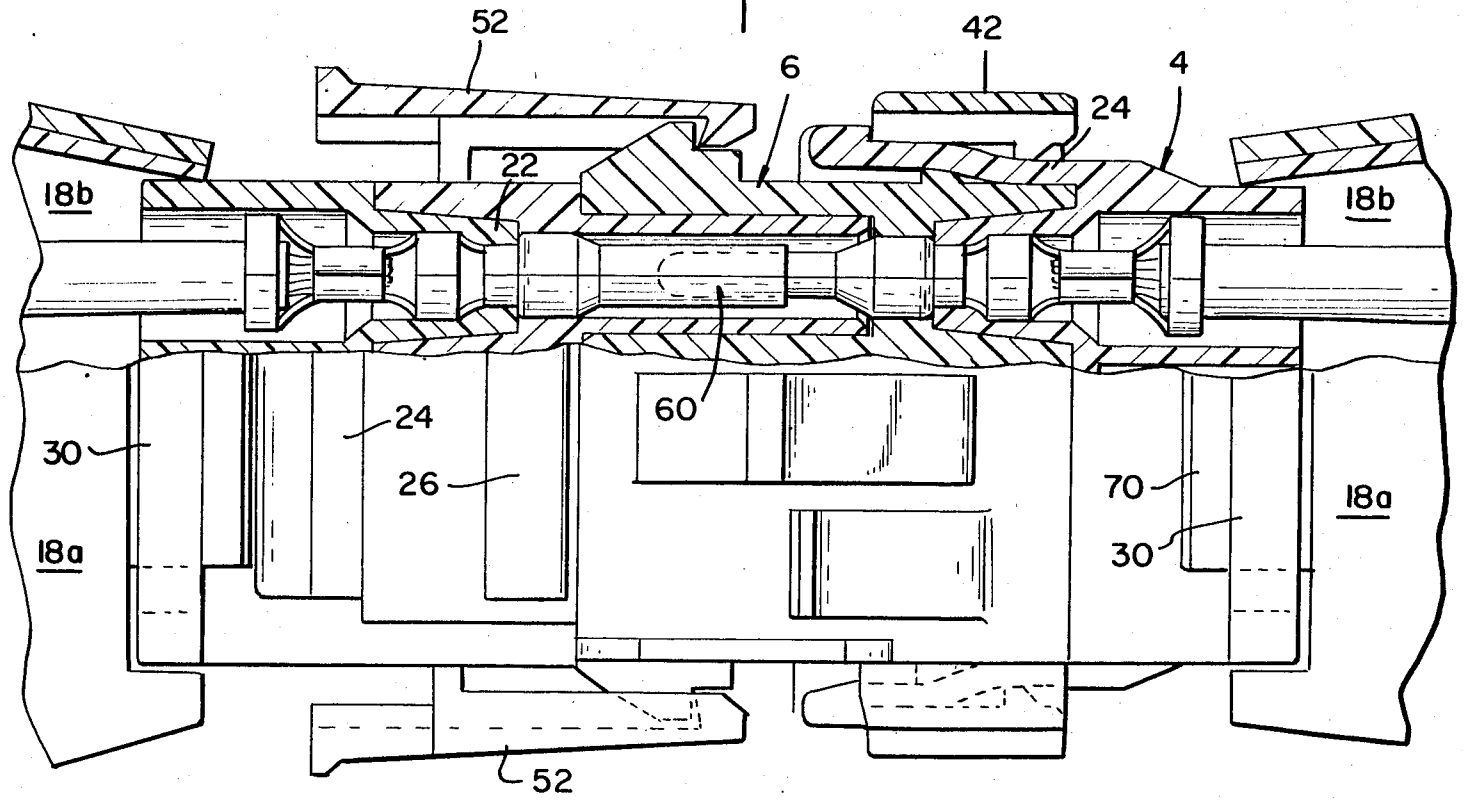
FIG. 11 is an assembled view partially in section showing two intermated connector halves with strain reliefs attached, one of these connector halves being constructed in accordance with the preferred embodiment of this invention.

The configuration of the terminal retainer 4 depicted herein is significantly complicated by the fact that other latching or retaining structures must be provided on the terminal retainer 4, the terminal housing 6, and on strain relief 18. FIGS. 9 and 10 demonstrate the numerous latching features which must be employed on the same structures. FIG. 9 shows that the flexible arm 24 must be positioned on the same side of the terminal retainer 4 as the strain relief straps 30. FIG. 10 shows that connector latching arm 52 must be provided on the exterior of the terminal housing 6 and on opposite sides from the coupling flanges 42. The complex configuration of the connector is further illustrated in FIG. 11 which shows the interengagement of a connector half consisting of terminal retainer 4, terminal housing 6, and a strain relief consisting of sections 18*a* and 18*b*. This connector half 2 is assembled to an otherwise conventional connector half 12 such as that described in U.S. Pat. No. 4,544,220. Note that the hook extensions 70 on strain relief 18, extend through and engage the straps 30. On the plug connector half 2, this engagement between the strain relief 18 and the terminal retainer occurs on the same side of the terminal retainer as the flexible latching arm 24, thus complicating the structure and the molding of the terminal retainer.

Although only a single preferred embodiment is depicted herein, other embodiments would be apparent to one skilled in the art from the description contained herein. Therefore, the following claims are not limited to this preferred embodiment.

What is claimed is:

1. An assembly comprising a plurality of terminals and a terminal housing and a terminal retainer intermatable to form a first connector half for interconnection to a mating second connector half; the terminal housing and the terminal retainer each comprising one-piece molded insulative members; the terminal housing and the terminal retainer each having a plurality of aligned cavities, each pair of aligned cavities containing a single terminal, the assembly being characterized by a two position latch means for retaining the terminal housing and the terminal retainer in first and second positions, the latch means comprising at least one flexible arm insertable into a coupling flange having open ends and a closed envelope, the coupling flange having two end walls and an outer wall spaced from one side of the terminal housing, and two spaced latching bosses, the first latching boss extending inwardly from the interior of the outer wall and the second latching boss being opposed thereto, whereby the flexible arm can be inserted through the coupling flange, the flexible arm having a shoulder positionable between the first and second latching bosses in the first position and insertable beyond the second latching boss camming the flexible arm outwardly into the second position to bring the shoulder into engagement with the outer wall in the second position.

2. The assembly of claim 1 wherein the flexible arm extends from the front of the terminal retainer and the coupling flange extends to one side of the terminal housing.

3. The assembly of claim 2 wherein the second latching boss is on the exterior of the one side of the terminal housing.

4. The assembly of claim 3 wherein the coupling flange outer wall is outwardly flexible upon movement of the flexible arm shoulder past the first and second latching bosses.

5. The assembly of claim 1 wherein the flexible arm shoulder is located on the exterior of and adjacent the free end of the flexible arm.

6. The assembly of claim 5 wherein the flexible arm shoulder is positioned in abutment with the first latching boss when the terminal retainer and the terminal housing are in the first position.

7. The assembly of claim 6 wherein the flexible arm engages the second latching boss when the terminal retainer and terminal housing are in the second position thereby camming the flexible arm outwardly, the shoulder engaging one end of the outer wall to lock the terminal retainer and the terminal housing in the second position.

8. The assembly of claim 3 wherein two flexible arms extend from opposite sides of the front end of the terminal retainer, integrally molded open ended straps extending from the rear end of the same opposite sides of the terminal retainer.

9. The assembly of claim 8 further comprising strain relief means attachable to the terminal retainer by engagement with the straps.

10. The assembly of claim 1 wherein the terminals are removable from the terminal retainer when the terminal retainer and the terminal housing are in the first position.

11. The assembly of claim 10 wherein the terminals are locked within the first connector half when the terminal retainer and the terminal housing are in the second position.

12. The assembly of claim 11 wherein the terminal retainer comprises a plurality of resilient terminal retention fingers, the terminal retention fingers being free to expand when the terminal retainer and the terminal housing are in the first position, the terminal retention fingers being received within corresponding cavities in the terminal housing when the terminal retainer and terminal housing are in the second position to lock the terminals in the first connector half.

* * * * *